US005113623A

United States Patent [19]

Figge et al.

[11] Patent Number: 5,113,623

[45] Date of Patent: May 19, 1992

[54] METHOD AND APPARATUS FOR GRINDING THE WORK ROLLS OF A PLANETARY ROLLING MILL

[75] Inventors: Dieter Figge; Peter Fink, both of Essen, Fed. Rep. of Germany

[73] Assignee: Mannesmann Aktiengesellschaft, Düsseldorf, Fed. Rep. of Germany

[21] Appl. No.: 490,741

[22] Filed: Mar. 8, 1990

[30] Foreign Application Priority Data

Mar. 10, 1989 [DE] Fed. Rep. of Germany ..... 3907730

[51] Int. Cl.[5] ..... B24B 1/00

[52] U.S. Cl. ..... 51/289 R; 51/326; 51/108 R; 51/215 AR; 51/236; 51/237 T

[58] Field of Search ..... 51/38, 49, 53, 79 R, 51/108 R, 215 AR, 236, 237 T, 251, 289 R, 326

[56] References Cited

U.S. PATENT DOCUMENTS

| | | | |
|---|---|---|---|
| 2,436,561 | 2/1948 | Flygare et al. | 51/108 R |
| 3,073,074 | 1/1963 | Price | 51/108 R |
| 3,333,452 | 8/1967 | Sendzinir | 72/184 |

*Primary Examiner*—Maurina Rachuba

*Attorney, Agent, or Firm*—Cohen, Pontani & Lieberman

[57] ABSTRACT

The work rolls of a planetary rolling mill are subject to high wear and must, therefore, be frequently reground to assure precision of the material rolled. With a life of the work rolls of about six hours, the expenditure of about 12 hours of a mechanic solely for the removal and reinstallation of the 48 rolls of a roll frame represents a considerable cost factor. To substantially reduce the time and expense of regrinding, a complete planet roll with cages and chocks is removed from a roll stand and clamped into a grinding device having a grinding wheel, and then the work rolls are ground, one after the other, in an installed state.

10 Claims, 4 Drawing Sheets

4
22
23
25
30
31
26
12
13
28
28
27
29
24
14

METHOD AND APPARATUS FOR GRINDING THE WORK ROLLS OF A PLANETARY ROLLING MILL

BACKGROUND AND SUMMARY OF THE INVENTION

The present invention relates to a method of grinding the work rolls of a planetary rolling mill and to a device for carrying out such method.

Planetary rolling mills have been known for many years. One embodiment thereof is described in U.S. Pat. No. 3,333,452. Such rolling means can be used to advantage in the manufacture of material in strip form for small and medium quantity production. Despite a large number of advantages in the manufacture of steel strip, they have not been widely used up to now in the production operations of the steel industry. One of the reasons for this—perhaps the main reason—is that the time required for changing and regrinding the required work rolls is rather long, a fact which, in view of the short service life wherein the work rolls are so worn after about six hours that they must be reground, is particularly important. The advantages of a planetary rolling mill with regard to low operating expense and low capital requirement are therefore opposed by the disadvantages of higher maintenance costs as compared with conventional rolling mills.

A typical planetary rolling mill includes two planet rolls, which in the sense used here, each comprises two chocks, a support body, two cages, and for instance 24 work rolls as well as 24 intermediate rolls. When the work rolls have been worn down to such an extent that they must be reground, the two planet rolls which are in use at the time are replaced by new work rolls, i.e. reground, or entirely new, work rolls. Such a replacement of planet rolls is possible in about 10 minutes, so that the rolling process is not greatly impaired thereby.

The planet rolls, which weigh about 100 tons each, are transported, after removal from the stand, to an assembly place where the work rolls ($2\times24$ rolls) are removed by hand. The intermediate rolls have a substantially longer life; they need be reworked only about every 20th time; in the normal case, therefore, they remain in the planet roll. The work rolls, after grinding of the individual rolls in a grinding device, are reinstalled by hand into the planet rolls.

Solely for the removal and reinstalling of the 48 work rolls of a roll stand for a rolling width of 1300 mm, about 12 hours work on the part of a mechanic is necessary, which, with a life of the work rolls of about 6 hours, constitutes a considerable cost factor.

An object of the present invention is to substantially reduce the time and expense for the necessary regrinding of the work rolls of a planetary rolling mill.

The foregoing object is achieved in a manner for grinding the work rolls of a planetary rolling mill wherein a complete planetary roll with cages and chocks is removed from a roll stand and clamped in a grinding device having a grinding wheel; and the work rolls are then ground, one after the other, in an installed condition in a manner such that the cages of the work rolls are fixed in each case in the grinding position for a specific work roll, with the corresponding work roll being moved radially outward so far that it can turn freely with respect to the corresponding intermediate roll and to the work roll being machined by corresponding multiple infeed and longitudinal movements of the grinding wheel; and then the complete planet roll is reinstalled into the roll stand after grinding.

In this method, the large amount of labor that was previously necessary for the removal, transportation to a grinding machine, and reinstalling of the work rolls is avoided. A complete planet roll, after removal from the roll stand, is transported to a special grinding device and clamped in it, and the work rolls are then ground one after the other in an installed condition. For this purpose, the cages in each case are turned by one roll spacing so that a work roll is precisely at the height of the center of the grinding wheel or somewhat below same, in which connection, by positioning somewhat below the same, a "pulling in" is reliably avoided even in unfavorable cases. In this position, the cages are stopped and the work roll to be ground is moved radially outward by a special device so that it no longer is in contact with the corresponding intermediate roll. The grinding wheel, which is located on the one side of the grinding device and possibly somewhat to the side of the work roll, is moved inward, i.e. as far in the direction of the work roll as is necessary for the first grinding operation, and then moved along the work roll. After another infeed on the opposite end of the work roll the next grinding operation takes place in opposite direction. This is repeated until a predetermined amount of removal or roll diameter has been reached. The grinding wheel is then moved backward, and the next work roll brought into grinding position and ground until all work rolls have been taken care of.

In order to assure a dependable grinding of the work rolls, it is necessary that they be turned during the grinding process. Various possibilities for this are conceivable. However, it is of particular advantage to turn the work roll by means of a separate friction roller having a drive of its own, preferably in a direction opposite the direction of rotation of the grinding wheel. After the friction roller has been swung into working position and the drive connected, i.e. the work roll is rotating, the grinding wheel is advanced and then moved along the work roll. Due to the special arrangement of a drive rocker in the form of a bracket arm and a rocker, an uninterrupted driving of the work roll to be ground is assured during the entire grinding process, as well as an unimpeded movement of the grinding wheel over the entire length of the work roll. It may be advantageous to use two friction rollers instead of a single one in order to achieve a dependable driving of the work rolls under even difficult conditions.

In accordance with a further development of the invention, the rotation of the cages and the radial displacement of the work rolls is effected by means in or on the cages themselves. For this purpose, the cages are provided with an outer toothing the pitch of which agrees with that of the work roll or is in the ratio thereto of a fraction having a whole-number denominator. The drive is effected by a relatively small drive motor independently of the drive of the grinding wheel. The radial displacement for lifting the work roll off from the corresponding intermediate roll is effected with particular advantage by a respective cylinder bore that is present under each spring package in the cages and a piston which is moveable therein. Through a feed bore, the space below the piston corresponding to the work roll to be ground is acted upon by pressure. In this way, the piston comes against the spring package, the latter is compressed and the work roll is thus moved radially outward and lifted off from the intermediate roll. The work-roll chocks come against adjustable fixed stops on the grinding machine and are clamped in a forced-locked manner in this position by the cylinders. The feed bores are provided on the outer mouths of the cage with quick-closure couplings so that, in each case, only the two feeds (right and left) of the work roll that are just about to be worked are connected, and the change in connection for the next work roll takes place very rapidly.

For the clamping of the work roll on the grinding device, the chocks are provided with grooves into which corresponding clamping elements or sliding blocks engage. The clamping elements or sliding blocks are pulled in by tie rods and hydraulic cylinders, thus pulling the chocks firmly against the clamping pedestals of the grinding device.

For an easy, time- and cost-saving grinding of work rolls of a planetary rolling mill, a complete planet roll with cages and chocks is removed from a roll stand and clamped in a grinding device having a grinding wheel. The work rolls are ground in an installed condition, one after the other, in a manner wherein (i) cages of the work rolls are in each case held fast in a grinding position for a specific work roll, (ii) the corresponding work roll is removed radially outward so far that it can turn freely with respect to a corresponding intermediate roll, and (iii) the work roll is machined by a corresponding multiple infeed and longitudinal movements of the grinding wheel. The complete planet roll is reinstalled in the roll stand after grinding. In such method, the grinding device used comprises a clamping pedestal for fixing in position the chocks, a compound slide for the grinding wheel, an indexing device for turning the cages, and a locking device, the foregoing items being arranged on a foundation plate or frame; and a bracket arm having a drive device with a friction roller for turning the work rolls which arm is firmly connected to, or directly alongside, the foundation plate or frame. The planetary roll is placed with its chocks on the foundation plate or foundation frame, possibly with interposed spacer plates. The clamping pedestal is connected to the foundation plate or foundation frame on one side and to the compound slide on the other side. The clamping pedestal is possibly adapted to be displaced and fixed in place by suitable fastening elements so as to permit adaptation to planet rolls of different diameter. The grinding wheel together with its drive is arranged on the compound slide. The infeed movement of the grinding wheel and its movement along the work roll are effected by means of this compound slide. The bracket arm having a drive device with a friction roller is firmly attached to, or directly alongside, the foundation plate or foundation frame. Furthermore, the grinding device has, between the clamping pedestal and the compound slide, a turning device provided with two pinions and two stop means that engage into the outer toothing of the cages.

One particularly advantageous development of the grinding device of the invention consists in arranging the drive device with a friction roller for driving the work roll as a rocker with an integrated gearing. This rocker is turnably supported on the upper end of the bracket arm facing the planetary roll. This mounting is provided, for the exact positioning of the friction roller (i.e. for the readjustment for the individual grinding steps) with an eccentric bushing. The other end of the rocker opposite the friction roller is acted on by a hydraulic cylinder by which the friction roller is swung, after the radial travel of the work roll to be machined, in such a way in the direction towards the planet roll that it comes to lie on the work roll to be ground and drives the latter. The friction roller is driven by a drive motor arranged on the rocker via a gearing integrated in the rocker. This friction drive is fixed in space while the grinding carriage bearing the grinding wheel carries out an oscillating movement.

The method of the invention for the grinding of work rolls of a planetary rolling mill and the apparatus necessary for this as well as the required structural development of the planet rolls are shown, for instance, in the accompanying FIGS. 1 to 5 and will be described in further detail below. Structural details with which the person skilled in the art will be acquainted have been omitted for ease in understanding the drawing.

BRIEF DESCRIPTION OF THE DRAWING FIGURES

Figure 3:
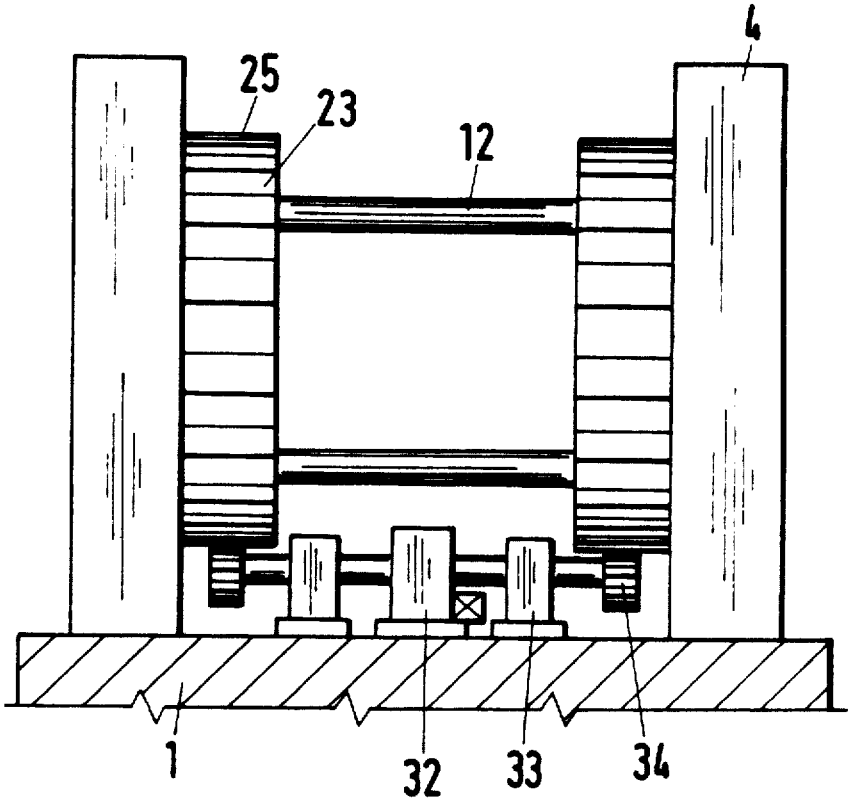

FIG. 3 diagrammatically shows an indexing device for turning the cages.

Figure 4:
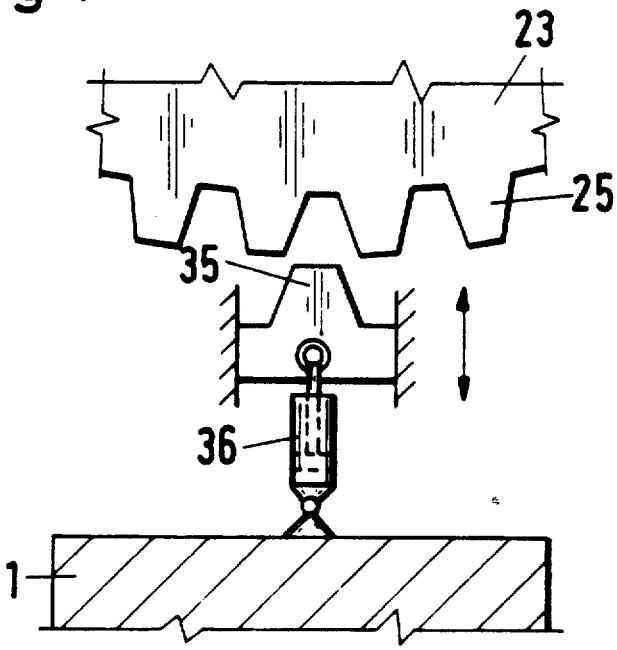

FIG. 4 diagrammatically shows a stop device for fixing cages in place.

Figure 5:
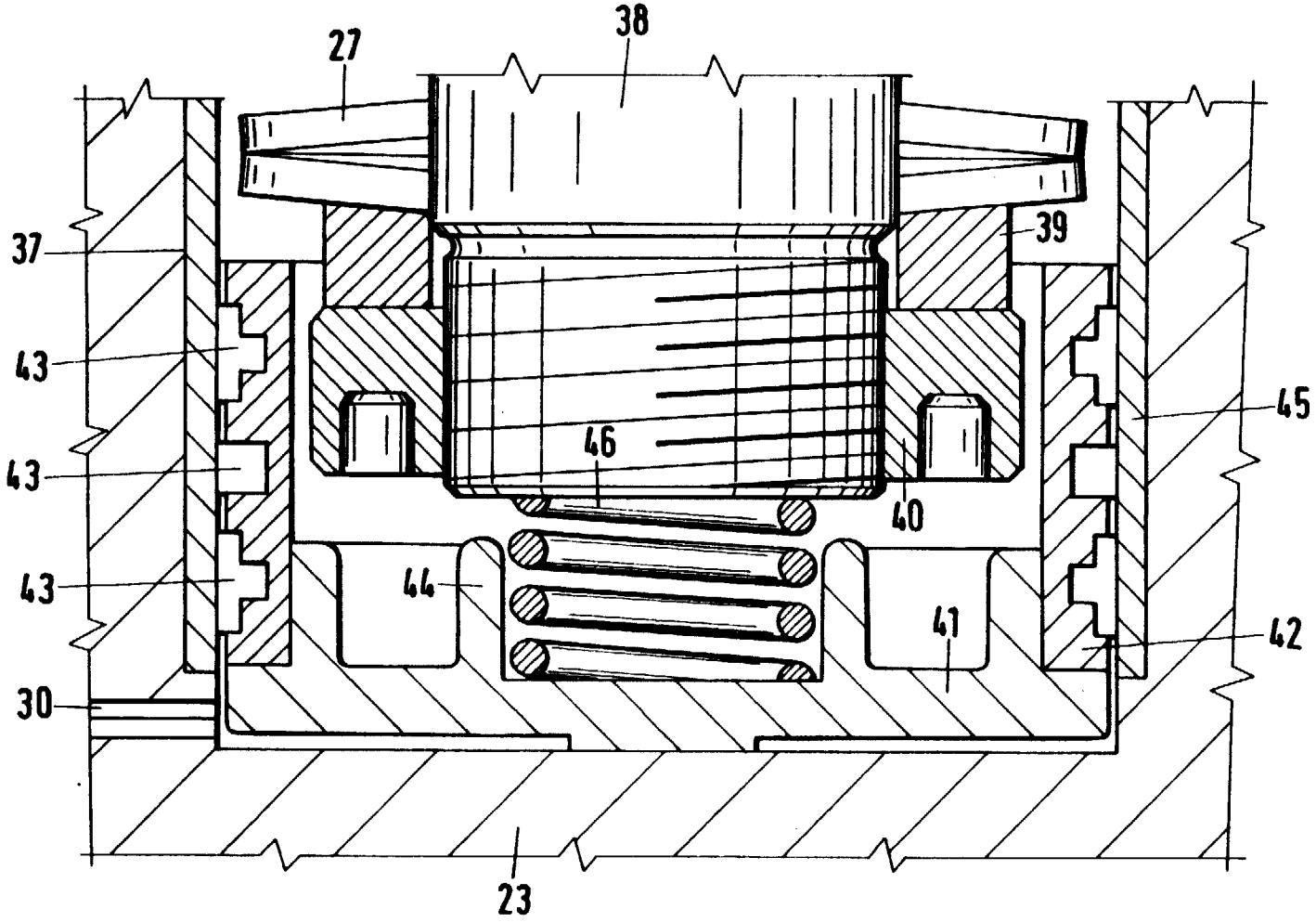

FIG. 5 is a partial section through a cage showing a cylinder bore and a piston for the radial movement of work rolls.

DETAILED DESCRIPTION OF THE PREFERRED EMBODIMENTS

Figure 1:
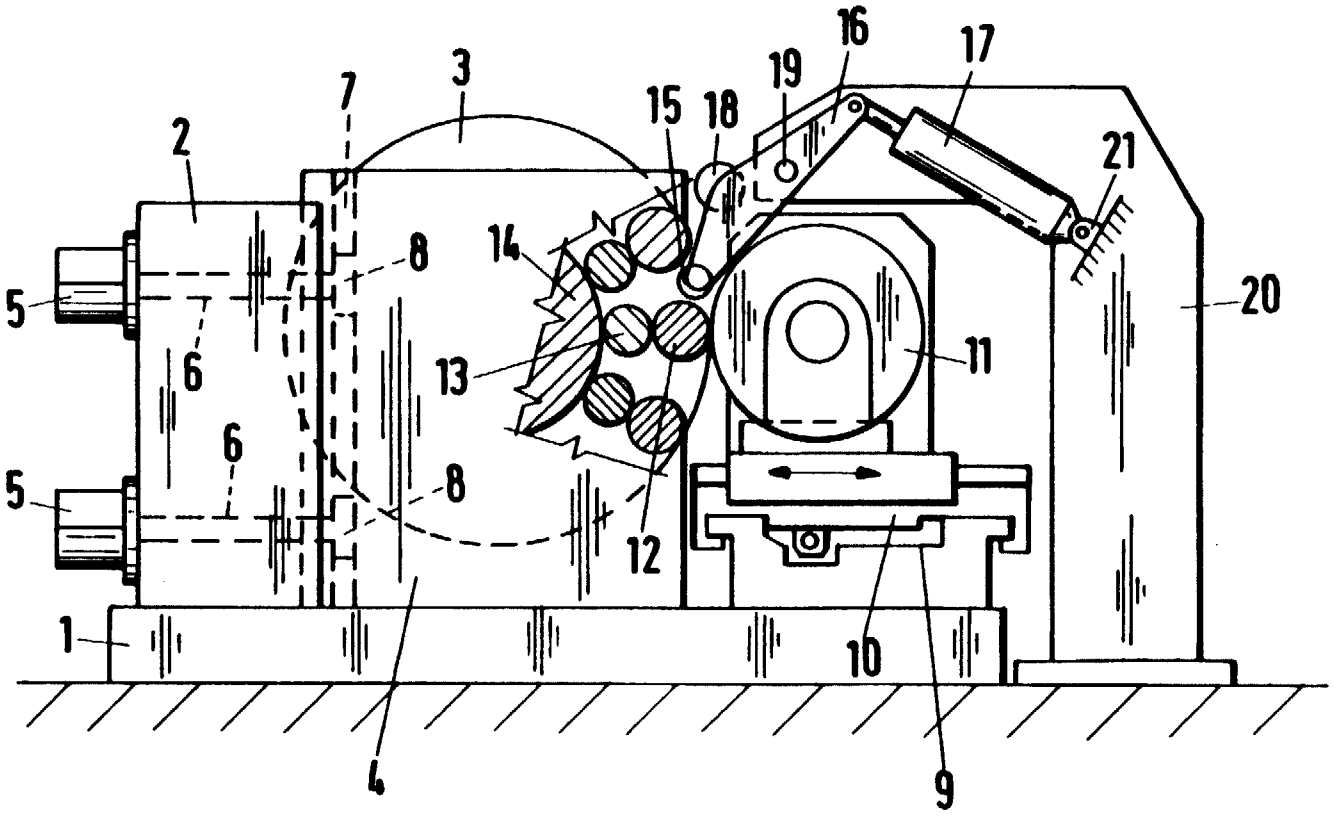
FIG. 1 shows a grinding device with a planet roll and a work roll in the grinding position.

FIG. 1 is an overall view of a device for carrying out the method of the invention. A clamping pedestal 2 for clamping a planet roll 3 is fastened on a foundation plate or frame 1. For this purpose, each of two chocks 4 is pulled by means of two clamping cylinders 5 firmly against the clamping pedestal 2, the force of the clamping cylinders 5 being transmitted via tie rods 6 and slide blocks 8 engaging in grooves 7. On the foundation plate or frame 1 there is furthermore arranged a guide bed on which a compound slide 10 can be moved. By means of the upper part of this compound slide 10, a grinding disk 11 can be adjusted, i.e. brought into grinding position and reset for individual grinding operations corresponding to the amount of material to be removed. For an individual grinding operation, the grinding wheel 11 is moved along a work roll 12 to be machined with the aid of the lower part of the compound slide 10. The work roll 12 which is to be ground is lifted, for grinding, by radial displacement outward from the corresponding intermediate roll 13 which, in turn, rests against the supporting body 14, so that such roll 12 can be freely turned or driven.

The drive of the work roll 12 during grinding is effected by a friction roller 15 which is mounted in a rocker 16. After radial movement of the work roll 12 to be machined, i.e. after lifting of such roll 12 from the corresponding intermediate roll 13 and before the start of the grinding process, the friction roller 15 is swung inward by a hydraulic cylinder 17 via the rocker 16 in such a manner that it comes against the work roll 12. The friction roller 15 is driven by a drive motor 18 via a gearing (not shown) integrated in the rocker 16. The rocker 16 is mounted by an eccentric bushing 19 in a bracket arm 20. Bracket arm 20 and rocker 16 are so constructed that the compound slide 10 and the grinding wheel 11 can be moved unimpeded along the work roll 12. A support 21 for the hydraulic cylinder 17 is also provided on the bracket arm 20.

Figure 2:
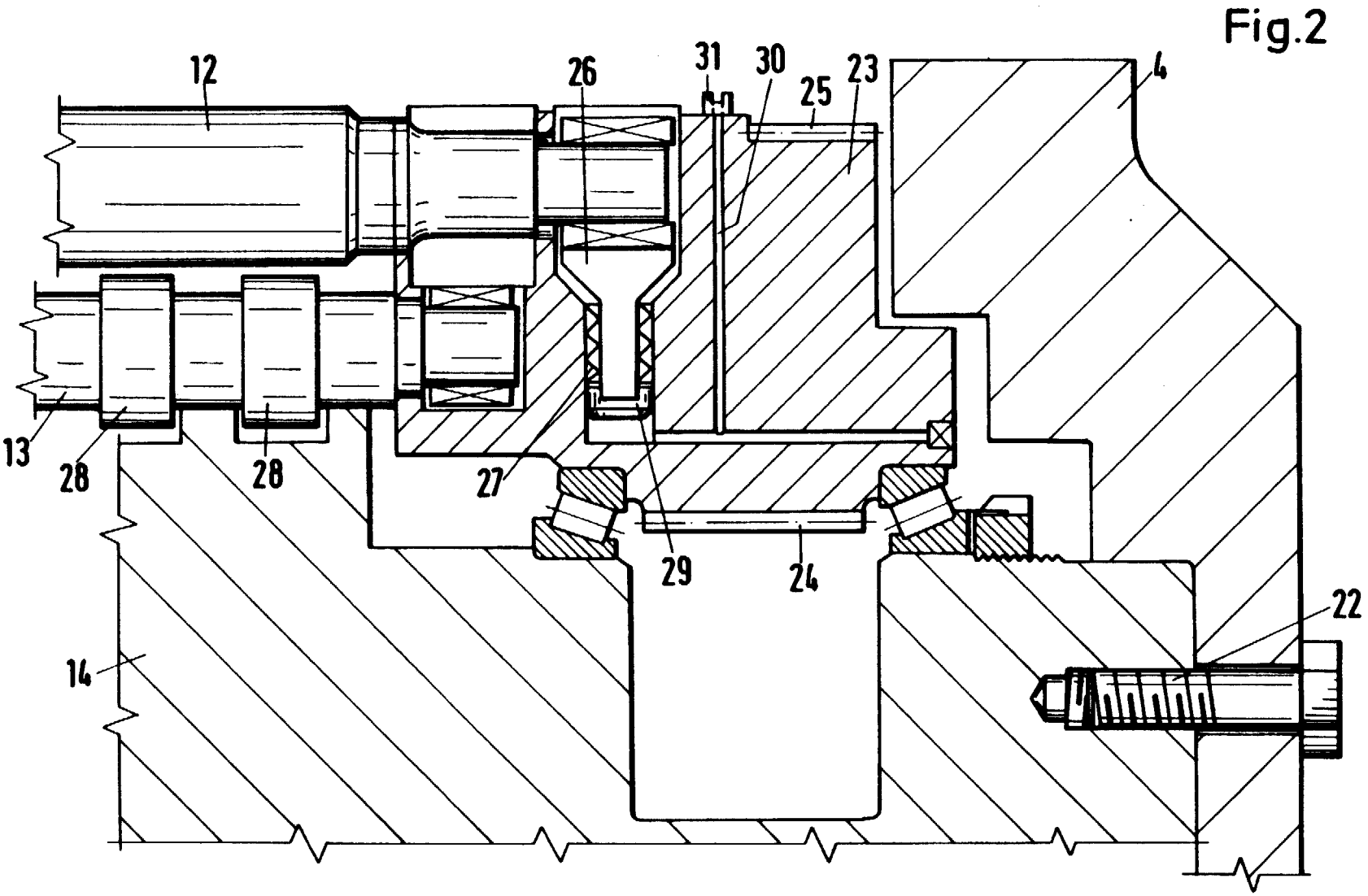
FIG. 2 is a partial section through a planet roll including a device for the radial displacement of the work roll to be machined.

The partial sectional view of FIG. 2 shows the structural arrangement of a planet roll (e.g. 3, FIG. 1) suitable for the method of the invention. The supporting body 14 is firmly attached by screws 22 to the chock 4, which is fixed both in the roll stand and in the grinding device, i.e. it does not move in either case; in other words, the supporting body 14 is always stationary as, for instance, during the grinding process. A cage 23 is mounted rotatably with respect to the supporting body 14 and travels around the same; the cage has an inner toothing 24 for the drive in the condition installed in the roll stand, i.e. in an operating condition, and an outer toothing 25 for turning the cage 23 in a grinding device during grinding. The work roll 12 is rotatably mounted directly in the cage 23 by a movable chock 26 and the intermediate roll 13. In the operating condition as well as in the removed condition of the planet roll, the work roll 12 is pressed by a spring package 27, against the action of centrifugal force upon rotation around the supporting body 14, against the support rings 28 of the intermediate roll 13. In the grinding position shown here, on the other hand, the work roll 12 is moved radially outward, i.e. upward in the plane of the drawing, by a piston 29 that compresses the spring package 27, so that the roll can turn freely or be driven during grinding. For lifting of the work roll 12 which is to be machined away from the intermediate roll 13, the bottom of the piston 29 is acted on by pressure via a feed bore 30. For this purpose, a corresponding source of pressure, for instance a hydraulic pump, is connected via a quick-closure coupling 31 on the outer circumference of the cage 23 when the corresponding work roll 12 has been brought into grinding position by the turning of the cage 23 by one roll spacing. The arrangement described here for one side of a work roll is, of course, present at each side of all work rolls.

FIG. 3 shows diagrammatically the indexing device by means of which the work rolls 12 are brought, one after the other, into machining position. The planet roll has its chocks 4 on the foundation plate or frame 1. Between the chocks there are arranged the drive unit 32 consisting of electric motor and gearing and bearings 33 as well as pinions 34 which engage into the outer toothing 25 of the cage 23. Since the indexing of the outer toothing 25 and the pinions 34 which engage therein are so dimensioned that they agree with the indexing of the work roll or their ratio corresponds to a fraction with a whole-number denominator, it is possible with a locking device such as shown diagrammatically in FIG. 4 to accurately position the specific work roll to be machined with respect to the grinding wheel. In the example, for this purpose, a pawl 35 having a prismatic profile is pressed by a hydraulic cylinder 36 resting on the foundation plate or frame 1 into the outer toothing 25 of the cage 23.

FIG. 5 is a partial section through the cage 23, in which the device for the radial displacement of the work rolls 12 (not shown in this figure) can be noted. FIG. 5 corresponds to the normal condition of operation in which the spring package 27 pulls the pin 38 (of the moveable chocks 26—not shown here—in which the work roll 12 is mounted) and thus the work roll 12 via an intermediate ring 39 and an annular nut 40 in the direction towards the center of the planet roll, i.e. downward in the plane of the drawing. For the radial displacement of the work rolls there is used the piston, which in this example consists of a piston head 41 and a piston skirt 42 with piston rings 43. For this purpose, the bottom of the piston head 41 is acted on by pressure via the feed bore 30. The piston thereby moves upward in the plane of the drawing and the annular extension 44 comes against the end of the pin 38 and presses it, upon further increase in pressure, against the force of the pressing-spring package 27 upward in the plane of the drawing (as a result of which the work roll is brought into the grinding position). For the purpose of machining, cylinder bore 37 is provided with a cylinder bushing 45. The piston is pressed by the springs 46 against the bottom of the cylinder bore 37 during operation in order to avoid continuous movement of the piston, i.e. wear.

It should be understood that the preferred embodiments and examples described are for illustrative purposes only and are not to be construed as limiting the scope of the present invention which is properly delineated only in the appended claims.

What is claimed is:

1. A method of grinding work rolls of a planetary rolling mill, comprising the steps of:

removing a complete planet roll having work rolls, cages and chocks from a roll stand, and clamping the same in a grinding device having a grinding wheel;

grinding the work rolls in an installed condition, one after the other, in a manner wherein (i) cages of the work rolls are in each case held fast in a grinding position for a specific work roll, (ii) the corresponding work roll is moved radially outward so far that it can turn freely with respect to a corresponding intermediate roll, and (iii) the work roll is machined by a corresponding multiple infeed and longitudinal movements of the grinding wheel; and reinstalling the complete planet roll in the roll stand after grinding.

2. A method according to claim 1, wherein the work roll to be machined is driven by a separate friction roller with its own drive before and during the grinding.

3. A method according to claim 1, wherein the grinding device comprises a clamping pedestal for fixing in position the chocks, a compound slide for the grinding wheel, an indexing device for turning the cages, and a lock device, which are arranged on a foundation plate or frame; and a bracket arm having a drive device with a friction roller for turning the work rolls and being firmly connected to, or directly alongside, the foundation plate or frame.

4. A method according to claim 3, wherein the drive device with a friction roller is arranged as a rocker mounted in the bracket arm and having an integrated gearing, with a pivot point of the rocker being adjustable by an eccentric shaft, wherein the friction roller is swingably mounted on one end of the rocker and a hydraulic cylinder engages the other end of the rocker.

5. The method according to claim 1, wherein said cages are held fast in grinding position for a particular work roll by outer toothing at said cages; and said work roll is moved into free turning position by actuating means at said planet roll for radially displacing said work rolls away from the corresponding intermediate roll.

6. The method according to claim 5, wherein said radial displacement means is actuated by pressure actuating a spring biased piston associated with each of said work rolls.

7. The method according to claim 5, wherein said planet roll is clamped into said grinding device by grooves in said chocks.

8. The method according to claim 6, wherein said planet roll is clamped into said grinding device by grooves in said chocks.

9. An apparatus for grinding the work rolls of a planet roll including said work rolls and associated intermediate rolls, cages and chocks, said apparatus comprising:

a foundation;

clamping means mounted on said foundation for sequentially fixing said chocks in a grinding position for one of said work rolls;

a grinding wheel;

means mounted on said foundation for locking said work roll in said grinding position;

means connected to said foundation and said grinding wheel for moving said grinding wheel into said grinding position after said work roll has been moved radially outward for free rotation thereof with respect to said associated intermediate roll; and a driven friction roller mounted along side said work roll for releasing the engaging said work roll and for turning said work roll in an engaged position during said grinding.

10. Means for practicing the method according to claim 1 comprising:

a foundation;

clamping means mounted on said foundation for sequentially fixing said chocks in a grinding position for one of said work rolls;

a grinding wheel;

means mounted on said foundation for locking said work roll in said grinding position;

means connected to said foundation and said grinding wheel for moving said grinding wheel into said grinding position after said work roll has been moved radially outward for free rotation thereof with respect to said associated intermediate roll; and a driven friction roller mounted along side said work roll for releasing the engaging said work roll and for turning said work roll in an engaged position during said grinding.

* * * * *